US007963335B2

(12) United States Patent
Krehbiel et al.

(10) Patent No.: US 7,963,335 B2
(45) Date of Patent: Jun. 21, 2011

(54) SUBSEA HYDRAULIC AND PNEUMATIC POWER

(75) Inventors: Drew Krehbiel, Richmond, TX (US); Richard D'Souza, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 712 days.

(21) Appl. No.: 11/958,722

(22) Filed: Dec. 18, 2007

(65) Prior Publication Data

US 2009/0151954 A1 Jun. 18, 2009

(51) Int. Cl.
*E21B 43/01* (2006.01)

(52) U.S. Cl. ..... 166/335; 166/357

(58) Field of Classification Search ..... 166/369, 166/45, 62, 105–105.4, 372
See application file for complete search history.

(56) References Cited

U.S. PATENT DOCUMENTS 3,261,398 A * 7/1966 Haeber ..... 166/352
3,400,730 A * 9/1968 Anderson ..... 137/236.1
3,469,627 A * 9/1969 Baker ..... 166/356
3,520,358 A * 7/1970 Brooks et al. ..... 166/356
3,546,474 A * 12/1970 Courcy et al. ..... 290/52
3,556,218 A * 1/1971 Talley et al. ..... 166/265
4,052,703 A * 10/1977 Collins et al. ..... 714/2
4,091,881 A * 5/1978 Maus ..... 175/7
4,095,421 A * 6/1978 Silcox ..... 60/398
4,112,687 A 9/1978 Dixon
4,285,401 A 8/1981 Erickson
4,848,471 A * 7/1989 Bencze ..... 166/335
4,878,540 A 11/1989 Raymond
5,149,984 A * 9/1992 Schultz et al. ..... 290/54
5,280,766 A * 1/1994 Mohn ..... 166/368
5,697,446 A * 12/1997 Giannesini ..... 166/354
5,839,508 A * 11/1998 Tubel et al. ..... 166/65.1
6,107,693 A 8/2000 Mongia et al.
6,202,753 B1 * 3/2001 Baugh ..... 166/364
6,536,528 B1 * 3/2003 Amin et al. ..... 166/369
6,760,275 B2 * 7/2004 Carstensen ..... 367/83
6,998,724 B2 * 2/2006 Johansen et al. ..... 290/1 R
7,011,152 B2 * 3/2006 Soelvik ..... 166/65.1
7,059,345 B2 * 6/2006 Shaw ..... 137/565.35
7,066,247 B2 * 6/2006 Butler et al. ..... 166/105
7,073,594 B2 7/2006 Stegemeier et al.
7,150,325 B2 * 12/2006 Ireland et al. ..... 166/366
7,152,682 B2 * 12/2006 Hopper ..... 166/357
7,219,737 B2 * 5/2007 Kelly et al. ..... 166/339
7,243,726 B2 * 7/2007 Ohmer ..... 166/304
7,249,634 B2 * 7/2007 de Albuquerque Lima Goncalves et al. ..... 166/335
7,400,262 B2 * 7/2008 Chemali et al. ..... 340/854.3
7,481,270 B2 * 1/2009 Shepler ..... 166/105
7,594,543 B2 * 9/2009 Goncalves et al. ..... 166/372
7,615,893 B2 * 11/2009 Biester et al. ..... 307/82
7,669,652 B2 * 3/2010 Shepler ..... 166/105
2003/0217848 A1 * 11/2003 Shaw ..... 166/366

(Continued)

*Primary Examiner* — Thomas A Beach
*Assistant Examiner* — James G Sayre
(74) *Attorney, Agent, or Firm* — KBR IP Legal Dept.

(57) ABSTRACT

Systems and methods for providing energy to sub-sea support equipment. Energy can be provided by diverting at least a portion of a fluid from a well producing system to sub-sea support equipment units that can be disposed in the vicinity of the sea-floor, sea-bed, or mud-line. The well producing system can include, but is not limited to, a water injection system, a gas lift system, or combinations thereof. A water injection system designed to provide pressure support to one or more wells can be modified to provide an operational power source to one or more sub-sea support equipment units.

22 Claims, 4 Drawing Sheets

U.S. PATENT DOCUMENTS

2004/0134662 A1* 7/2004 Chitwood et al. ..... 166/367
2004/0154794 A1* 8/2004 Appleford et al. ..... 166/267
2004/0251030 A1* 12/2004 Appleford et al. ..... 166/357
2005/0145388 A1* 7/2005 Hopper ..... 166/357
2005/0179263 A1* 8/2005 Johansen et al. ..... 290/1 R
2006/0064256 A1* 3/2006 Appleford et al. ..... 702/31
2006/0157254 A1* 7/2006 Baggs ..... 166/368
2008/0264642 A1* 10/2008 Horton ..... 166/341
2008/0308270 A1* 12/2008 Wilson ..... 166/244.1
2009/0038804 A1* 2/2009 Going, III ..... 166/335
2010/0025043 A1* 2/2010 Ingebrigtsen et al. ..... 166/339

* cited by examiner

SUBSEA HYDRAULIC AND PNEUMATIC POWER

BACKGROUND

1. Field

The present embodiments generally relate to methods and processes for providing power for sub-sea uses. More particularly, embodiments of the present invention relate to methods and processes for providing power to sub-sea equipment disposed in the vicinity of the sea-floor.

2. Description of the Related Art

Water injection and gas lift techniques are two of a number of processes used to artificially lift liquid, typically hydrocarbons, from wells where there is insufficient reservoir pressure to produce or finish the well. For water injection, water is injected into a well to provide the reservoir with pressure support, also known as voidage replacement, and to sweep or displace a production product in the well, typically oil, from the reservoir, pushing the production product towards a wellbore exit or producer. For gas lift, the process involves injecting gas, typically through a wellbore or tubing-casing annulus, into a well. Injected gas aerates the fluid in the well to make it less dense. The formation pressure resident in the well is then able to lift the production product and force the production product out of the wellbore. Gas can be injected continuously or intermittently depending on the producing characteristics of the well and the arrangement of the gas-lift equipment.

In sub-sea environments, additional sub-sea support equipment is typically required to lift the production product from the wellbore to the sea surface. In some production environments, the production product is processed or partially processed at or near the sea-floor or mud-line prior to being lifted to the surface. This support equipment can include pumps, centrifuge separators, other multiphase separators, or any equipment that can be disposed at or near the mud-line in the vicinity of one or more wells.

Surface located power distribution systems provide power to the sub-sea support equipment via electrical umbilicals. The umbilicals are supported from the surface by various known devices and routed down to the sub-sea support equipment. The umbilicals must be capable of handling the sub-sea environments and capable of delivering power to the equipment. The sub-sea environmental and service requirements imposed on the umbilicals necessitate the use of umbilicals that are expensive, bulky, and relatively hard to manage.

A need exists to provide power to sub-sea equipment using methods and processes that can reduce the complexity of or completely eliminate the need for surface supported electrical umbilicals.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for providing energy to sub-sea support equipment are provided. In one or more embodiments, the energy can be provided by diverting at least a portion of a fluid from a well producing system to sub-sea support equipment units that can be disposed in the vicinity of the sea-floor, sea-bed, or mud-line. The well producing system can include, but is not limited to, a water injection system, a gas lift system, or combinations thereof. In one or more embodiments, a water injection system designed to provide pressure support to one or more wells can be modified to provide an operational power source to one or more sub-sea support equipment units. In one or more embodiments, a gas injection system, typically designed to provide gas to one or more wells to aerate the fluid in the well, can be modified to provide a pressurized fluid source to the one or more sub-sea support equipment units. The one or more sub-sea support equipment units can be disposed at the mud-line. In at least one specific embodiment, the method includes diverting at least a portion of a pressurized fluid used by a well producing system, wherein the diverted fluid defines a diverted fluid energy source, providing the diverted fluid energy source to a sub-sea support equipment unit for use as an operational power source, and wherein the sub-sea support equipment unit is disposed in the vicinity of a mud-line.

Figure 1:
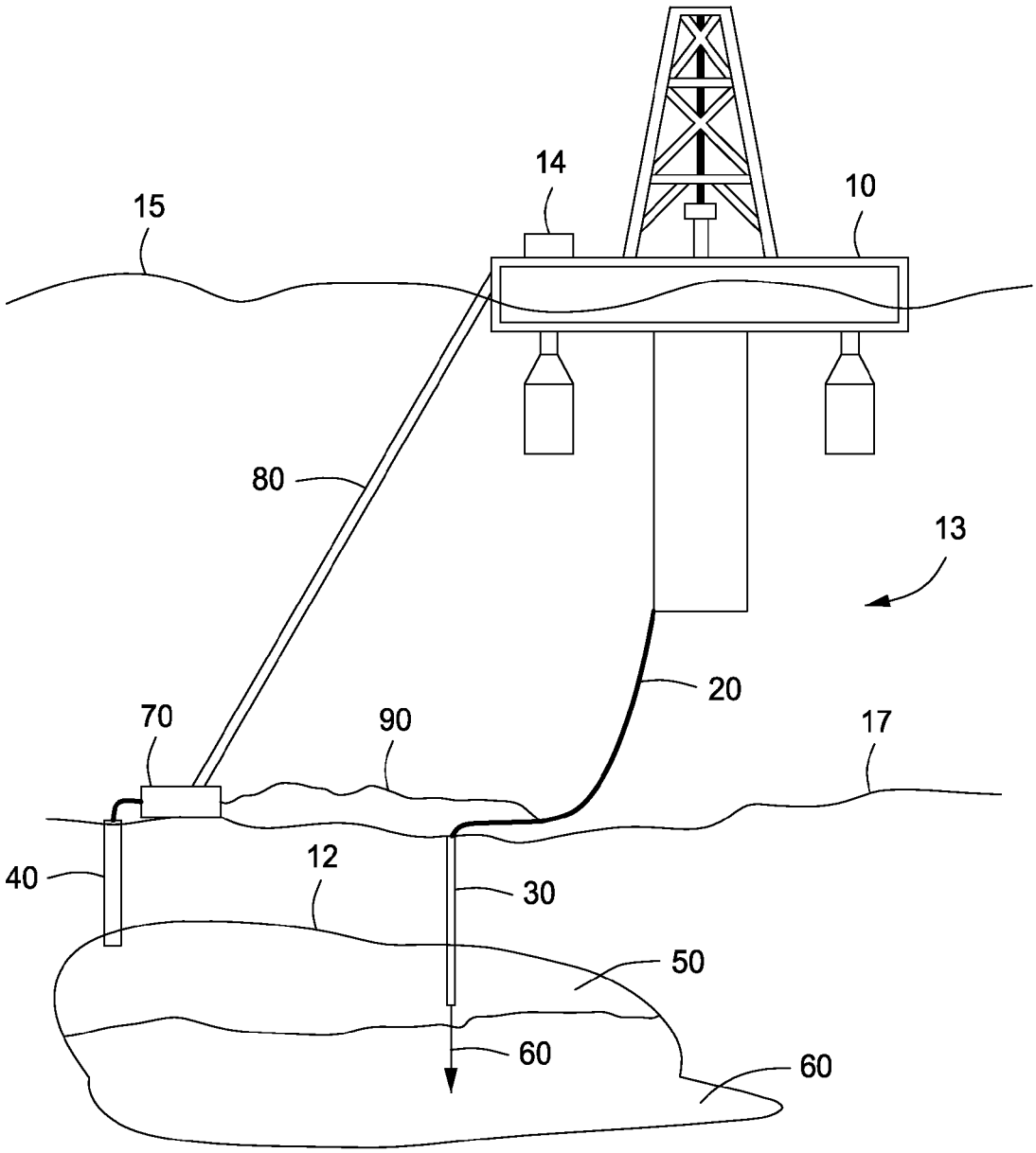
FIG. 1 depicts a schematic of an illustrative method for providing an operational power source to one or more sub-sea support equipment units disposed below a water line according to one or more embodiments.

With reference to the figures, FIG. 1 depicts a schematic of an illustrative method for providing an operational power source to one or more sub-sea support equipment units disposed below a water line according to one or more embodiments. In one or more embodiments, an illustrative surface facility 10 can pump a fluid 60 to a well 12 via a casing, conduit, or pipe 20 and an annulus 30 to support lifting a production product 50 to an annulus or wellbore exit 40 as part of a well producing system 13. The surface facility 10 can be a fixed or floating platform, a ship, or any other surface facility located above a water line 15 and capable of providing a fluid energy source for the well producing system 13. The fluid energy source can be any pressurized fluid. The well producing system 13 can be any known system capable of pumping the fluid 60 into a well to support lifting the production product 50 to the wellbore exit 40. In one or more embodiments, the production product 50 can be a hydrocarbon. In one or more embodiments, the fluid 60 can be any liquid capable of providing pressure support to the production product 50 including water, processed sea water, unprocessed sea water, drilling fluids, other known pressure support fluids, variations of each and/or combinations thereof.

One or more sub-sea support equipment units 70 can be disposed in the vicinity of a mud-line 17 or on the mud-line 17, and in the vicinity of the well 12. The support equipment units 70 can support hydrocarbon processing and/or support lifting of the production product 50 from the wellbore exit 40 to other destinations outside the well 12. For example, the support equipment units 70 can raise the flow pressure of the production product 50 to the required minimum pressure for introduction into a pipeline system, not shown, and introduce the production product 50 into the pipeline system. The support equipment units 70 can lift the production product 50 via conduit 80 from the wellbore exit 40 to above the water line 15 where the production product 50 can be stored, for example, in one or more tanks 14 disposed about the surface facility 10. The one or more support equipment units 70 can be in fluid communications with a pressurized fluid 90. The pressurized fluid 90 can be diverted from the pipe 20. One or more of the support equipment units 70 can receive operational power from at least a portion of the fluid flowing through the pipe 20 by diverting at least a portion of the fluid 60, for example the pressurized fluid 90, into the one or more support equipment units 70. In one or more embodiments, all of the fluid flowing through the pipe 20 can be diverted to the one or more support equipment units 70. For example, when the well producing system 13 is not providing fluid into the annulus 30 but the support equipment units 70 require operational power, all of the fluid from the well producing system 13 can be diverted to provide operational power to the support equipment units 70. The one or more support equipment units 70 can be placed in fluid communications with the pipe 20 through the use of tubing, piping, or any known device or method that can accommodate the transmission of the fluid 90 between the support equipment units 70 and the pipe 20.

The pressurized fluid 90 can be provided to the one or more support equipment units 70 as an operational power source. The pressurized fluid 90 can be used to power or energize one or more of the support equipment units 70 in lieu of providing electrical power from separate electrical power generation systems, not shown. For example, the well producing system 13 can be a water injection system where the fluid 60 can include some water, and the fluid 60 can be injected into the well 12 via annulus 30 to provide pressure support to the production product 50 located in the well 12. The pressurized fluid 90 can be diverted from some of the fluid flow from the water injection system to the one or more of the support equipment units 70 by siphoning off at least some of the fluid 60 from the water injection system and providing the pressurized fluid 90 to at least one of the support equipment units 70. In one or more embodiments, the one or more support equipment units 70 can receive the pressurized fluid 90 and can convert the fluid flow into rotational energy for operating a pump, motor, other equipment, and/or for generating electricity.

In one or more embodiments, the support equipment unit 70 can be any known device or method. For example, the one or more units 70 can include one or more multi-phased pumps, one or more centrifuge separators, other multi-phase separators, one or more components of a gas dehydration processing system, one or more components of a sulfur removal system, and/or one or more components of any system that can support hydrocarbon processing and/or support lifting of the production product 50 via conduit 80 away from the well 12, for example to storage tanks 14 located above the water line 15. In one or more embodiments, the support equipment units 70 support lifting of the production product 50 into the pipeline system, not shown. In one or more embodiments, the support equipment units 70 can be disposed in the vicinity of the mud-line 17. One or more of the support equipment units 70 can be disposed in the vicinity of a producing well 12 and can be in fluid communications with the annulus 40.

In one or more embodiments, an existing well producing system 13 can be modified to provide the pressurized fluid 90 to the one or more support equipment units 70 for use as an operational power source by accepting a pressure drop at the mud-line 17 to energize the one or more support equipment units 70 through the use of the pressure differential. For example, an existing well producing system 13 might be optimized to pump the fluid 60 at 2300 pounds per square inch into well 12 to support the production of the well 12. In one or more embodiments, power can be provided to the one or more support equipment units 70 by increasing the pressure of the fluid 60, diverting at least some of the fluid 60 to the one or more support equipment units 70, and converting the diverted fluid into an operational power source for use by at least one of the support equipment units 70. In one or more embodiments, to provide an operational power source to one or more of the support equipment units 70, the pressure of the fluid 60 in pipe 20 can be increased by about 1.2 times over the pressure that would normally be required to produce the well 12. In one or more embodiments, the pressure of the fluid 60 in pipe 20 can be increased by about 1.1 times to about 1.5 times over the pressure that would normally be required to produce the well 12. In one or more embodiments, the pressure of the fluid 60 in pipe 20 can be increased by about 1.1 times to about 2.0 times over the pressure that would normally be required to produce the well 12. The pressure of the fluid 60 in the pipe 20 can be increased from about 1.1 times the pressure that would normally be required to produce the well 12 up to the maximum allowable working pressure (MAWP) for the pipe 20, the components used to divert the pressurized fluid 90, and/or the support equipment units 70.

It should be understood that for some well producing systems 13, the piping used to provide the fluid 60 to the well 12 can be designed to counteract the pressures imposed on the outer surface of the pipe 20 by the surrounding sea. For example at 8000 feet, the pipe used to provide the fluid 60 to the well 12 can be crush depth pipe capable of counteracting the sea pressure encountered at a depth of at least 8000 feet. The pressure at 8000 feet is about 3470 pounds per square inch. In one or more embodiment, increasing the pressure in an existing well producing system 13 can be done without upgrading or replacing the pipe 20 if, for example, the increased pressure in the pipe does not exceed the burst pressure or the MAWP of the pipe 20.

Figure 2:
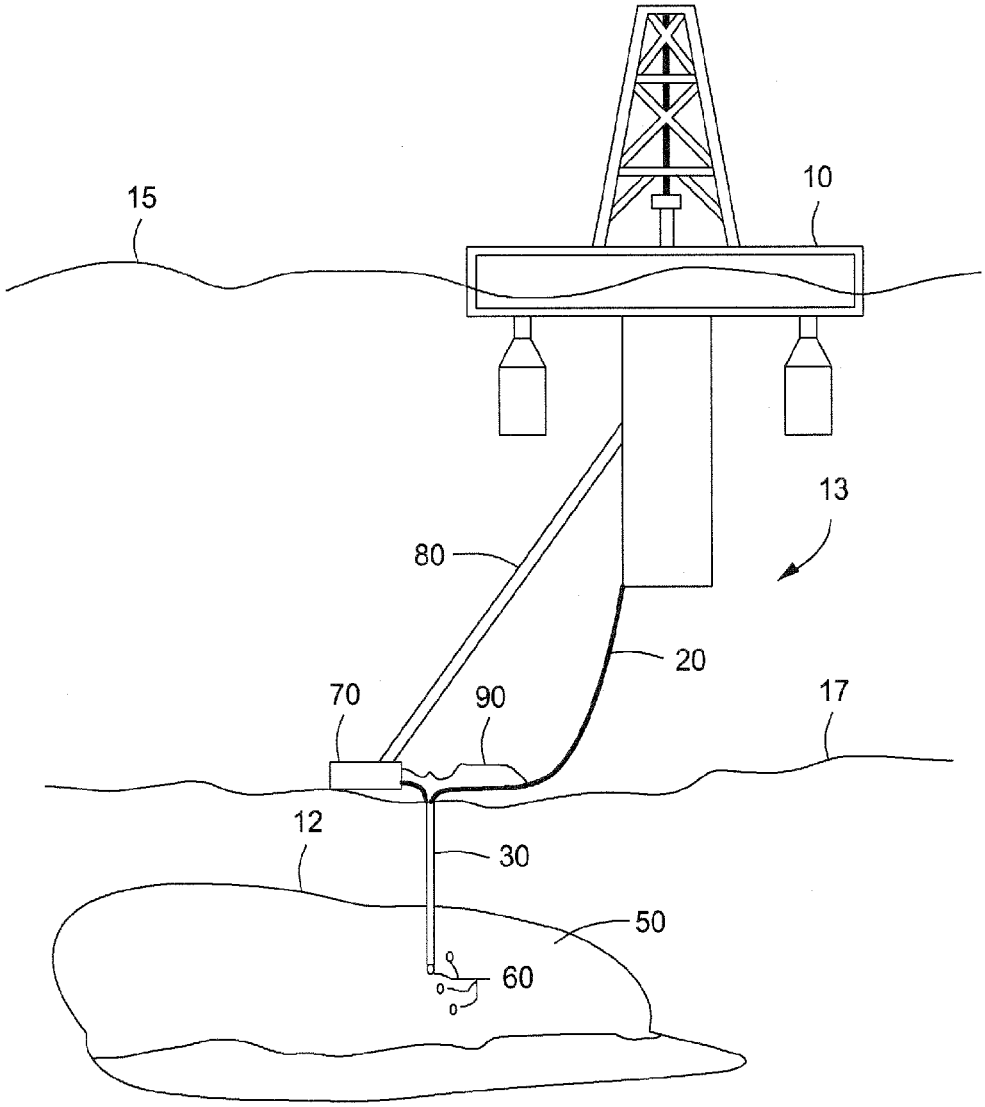
FIG. 2 depicts a schematic of an illustrative method for providing an operational power source to the one or more sub-sea support equipment units disposed below the water line according to one or more embodiments.

FIG. 2 depicts a schematic of an illustrative method for providing an operational power source to the one or more sub-sea support equipment units disposed below the water line according to one or more embodiments. In one or more embodiments, the well producing system 13 can be a gas lift system where at least a portion of the fluid 60 is a gas. The fluid 60 can be pumped from the surface facility 10 through the pipe 20 and can be injected into the well 12 via annulus 30 to aerate the production product 50. The formation pressure resident in the well 12 can lift the production product 50 and force the production product 50 out of the wellbore exit via annulus 30. In one or more embodiments, the gas in the fluid 60 can include any gas or gas mixture capable of aerating the production product 50 including various concentrations of air, oxygen, nitrogen, carbon dioxide, helium, any known gas suitable for use in a gas lift system, variations of each and/or combinations thereof.

One or more support equipment units 70 can be disposed on the mud-line 17 in the vicinity of the well 12. The one or more support equipment units 70 can be in fluid communications with the pressurized fluid 90. At least a portion of the pressurized fluid 90 can be in a gaseous state. In one or more embodiments, the pressurized fluid 90 can energize at least one of the support equipment units 70 by diverting at least a portion of the fluid 60 flowing through the pipe 20 to at least one of the support equipment units 70. For example, the pressurized fluid 90 can be provided to the one or more support equipment units 70 and the one or more support equipment units 70 can convert the pressurized fluid 90 into rotational energy for operating a pump and/or for generating electricity.

In one or more embodiments, an existing well producing system 13 can be modified to provide an operational power source for the one or more support equipment units 70. For example, the existing well producing system 13 might be optimized to pump gas at 3300 pounds per square inch into well 12 to support the production of the well 12. Power can be provided to the support equipment unit 70, for example, by increasing the pressure of the gas to about 4000 pounds per square inch, diverting the additional pressure to the support equipment unit 70, and accepting the pressure drop at the mud-line 17 to energize at least one of the support equipment units 70 through the use of the pressure differential. In one or more embodiments, to provide an operational power source to one or more of the support equipment units 70, the pressure of the fluid 60 in the pipe 20 can be increased by about 1.2 times over the pressure that would normally be required to produce the well 12. In one or more embodiments, the pressure of the fluid 60 in the pipe 20 can be increased by about 1.1 times to about 1.5 times over the pressure that would normally be required to produce the well 12. In one or more embodiments, the pressure of the fluid 60 in the pipe 20 can be increased by about 1.1 times to about 2.0 times over the pressure that would normally be required to produce the well 12. The pressure of the fluid 60 in the pipe 20 can be increased from about 1.1 times the pressure that would normally be required to produce the well 12 up to the maximum allowable working pressure (MAWP) for the pipe 20, the components used to divert the pressurized fluid 90, and/or the support equipment units 70.

Figure 3:
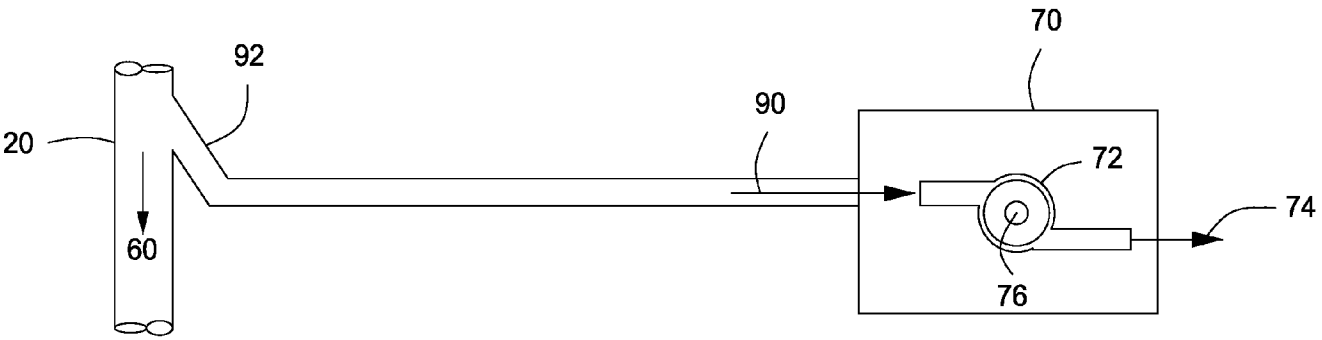
FIG. 3 depicts a schematic of an illustrative method for converting a diverted fluid into an operational power source for use by one or more support equipment units according to one or more embodiments.

FIG. 3 depicts a schematic of an illustrative method for converting diverted fluid into an operational power source for use by one or more support equipment units according to one or more embodiments. In one or more embodiments, the pipe 20 can be in fluid communications with one or more support equipment units 70 via a pipe or interface 92. The interface 92 can divert at least some of the fluid 60 flowing through the pipe 20 and provide the pressurized fluid 90 to the one or more support equipment units 70. The support equipment units 70 can convert the energy in the fluid 90 into mechanical energy for direct mechanical drive of at least one of the support equipment units 70.

In one or more embodiments, the support equipment unit 70 can convert the pressure from the pressurized fluid 90 through the use of one or more motors 72 disposed within at least one of the support equipment units 70. In one or more embodiments, one or more of the motors 72 can include a shaft 76. In one or more embodiments, the motors 72 can include an impulse wheel, not shown, that can be placed into motion by the fluid 90 flowing through the motor 72. The impulse wheel can be in rotational communications with the shaft 76 and when the wheel rotates, the rotational energy can be transferred to the shaft 76 causing the shaft 76 to rotate. The shaft 76 can be attached to other mechanical equipment, not shown, disposed inside the unit 70 to provide direct mechanical operation of the other mechanical equipment. The shaft 76 can be in mechanical communications with one or more other support equipment units 70, disposed in the vicinity of the shaft 76, and can provide direct mechanical power to the other units 70. In one or more embodiments, a Pelton wheel, a Jacobson wheel, any impulse type wheel, and/or a turbine can be used to convert the pressure from the fluid 90 into mechanical energy for direct mechanical drive of at least one of the support equipment units 70.

In one or more embodiments, after providing an operational power source to one or more of the support equipment units 70, the fluid 74, that has transferred at least some of its energy to the one or more of the support equipment units 70, can be expelled from the units 70 into the surrounding sea. The fluid 74 can be expelled from the units 70 and provided to one or more other support equipment units 70, as an operational power source for the other support equipment units 70. The fluid 74 can be expelled from the units 70 back to the surface and/or down-hole to support well production and/or for use as additional power source by any known device or method. For example, the fluid 74 can be provided down-hole as additional support for producing the well 12 and/or the fluid 74 can be provided to down-hole equipment, not shown, as an operational power source for the down-hole equipment.

Figure 4:
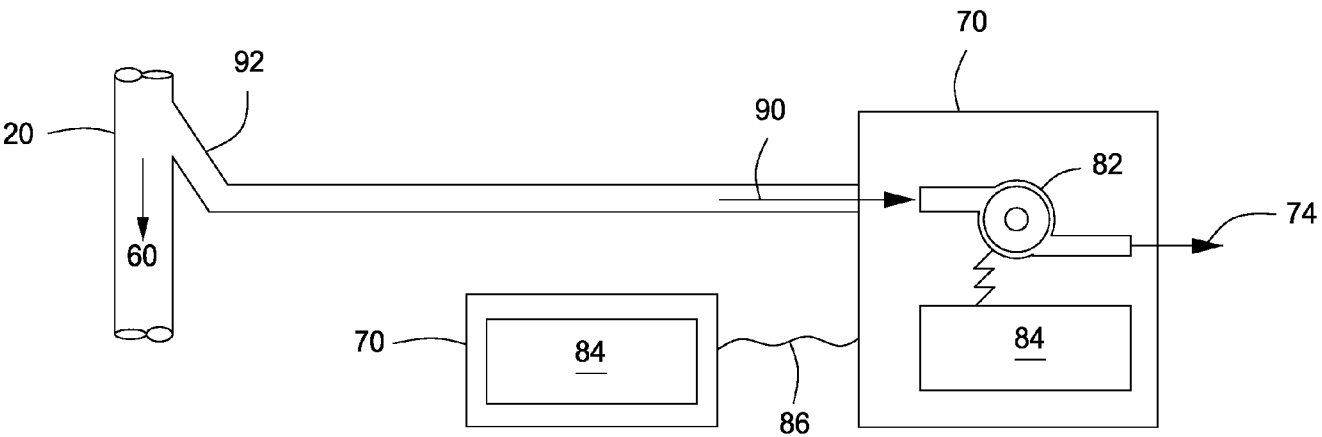
FIG. 4 depicts a schematic of an illustrative method for converting the diverted fluid into electricity for use by one or more support equipment units according to one or more embodiments.

FIG. 4 depicts a schematic of an illustrative method for converting the diverted fluid into electricity for use by one or more support equipment units according to one or more embodiments. In one or more embodiments, one or more motors 82 can be used to convert the fluid 90 into electricity or electrical energy. The electrical energy can be provided as an operational power source to electrically powered equipment 84 disposed in unit 70. For example, a Pelton wheel, Jacobson wheel, other impulse type wheel, and/or turbine can be disposed within the one or more motors 82 for converting the pressure from the fluid 90 into rotational energy that can be converted into electrical energy that can be provided as an operational power source to the electrically powered equipment 84. Converting rotational energy into electrical energy can be performed using any known method or process. Once the fluid 90 has transferred at least some of its energy to the one or more motors 82, the less energetic fluid 74 can be expelled from the units 70. It should be understood that there are no limitations on the methods or processes that can be used to convert the fluid 90 into an operational energy source suitable for providing electricity to the electrically powered equipment 84 and any suitable method or process can be used.

In one or more embodiments, the electrical energy that can be generated by motor 82 can be provided to the one or more units 70 disposed in the vicinity of motor 82. The electrical energy can be provided using any known method or process. For example, the electrical energy can be provided through the use of electrical umbilicals 86 disposed between the two or more units 70. In one or more embodiments, the electrical energy can be generated by a hydraulically or pneumatically powered electrical power generation unit, not shown, disposed in the vicinity of the support equipment units 70. The generated electricity can be provided to the one or more units 70 using any known method or process.

In one or more embodiments, where the fluid flow through pipe 20 is intermittent, batteries, not shown, can be used to store electrical energy for use by the support equipment units 70. For example, in some water-injection systems, the fluid 60 is pumped intermittently through the pipe 20. During those occasions when the fluid 60 is not being pumped into the well 12, rather than stopping the fluid flow through the pipe 20, all of the fluid can be diverted to the one or more support equipment units 70. The diverted fluid can be used to generate electricity and the electricity can be stored in batteries, not shown. The battery stored electricity can be used, for example, when no fluid is flowing through pipe 20, to provide an operational power source to the one or more support equipment units 70.

In one or more embodiments, the interface 92 can include any known device or process capable of diverting at least some of the fluid resident in the pipe 20 to the one or more support equipment units 70. For example, the interface 92 can include one or more valves that can vary the amount of pressure that can be diverted from pipe 20 to the one or more support equipment units 70. The interface 92 can include a fixed orifice that can limit the amount of fluid 90 that can be diverted to the one or more support equipment units 70.

Figure 5:
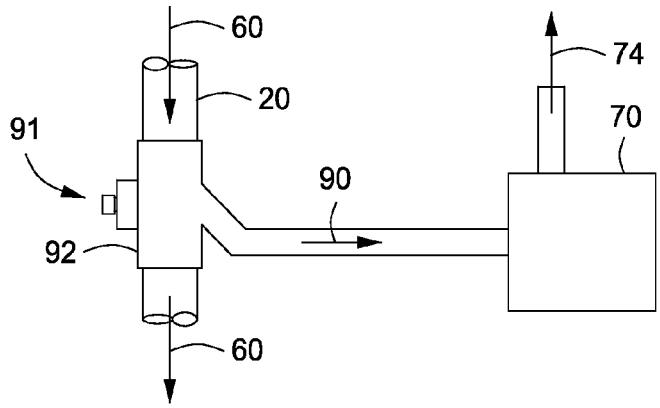
FIG. 5 depicts a schematic of an illustrative method for diverting at least a portion of a fluid flowing through a pipe to provide an operational power source for use by one or more support equipment units according to one or more embodiments.

FIG. 5 depicts a schematic of an illustrative method for diverting at least a portion of a fluid flowing through a pipe to provide an operational power source for use by one or more support equipment units according to one or more embodiments. The interface 92 can include a control valve 91. For example, one type of control valve known in the art is a split control valve. The control valve 91 can divert at least a portion of the fluid 60 flowing through pipe 20 to the support equipment units 70. The control valve 91 can control the pressure of the pressurized fluid 90 and the fluid 60 such that after passing through the control valve 91, the fluid 60 is pressurized appropriately for supporting a producing well, such as well 12 shown in FIG. 1 above. Returning to FIG. 5, the fluid 90 can be pressurized appropriately for providing an operational power source to the one or more support equipment units 70. Once the fluid 90 has transferred at least some of its energy to one or more of the support equipment units 70, the less energetic fluid 74 can be expelled from the units 70.

Figure 6:
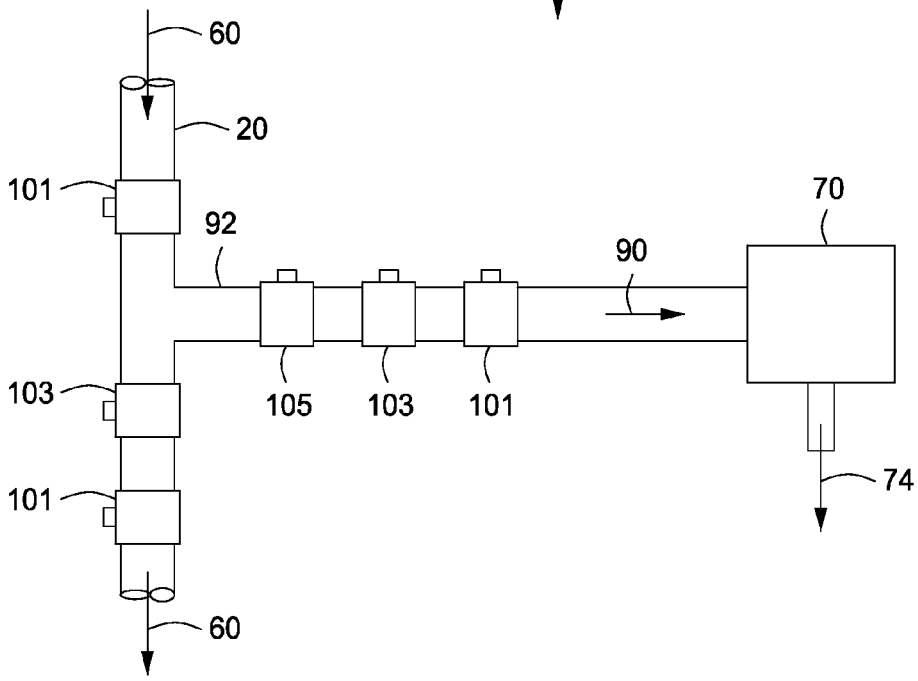
FIG. 6 depicts a schematic of an illustrative method for diverting at least a portion of a fluid flowing through a pipe to provide an operational power source for use by one or more support equipment units according to one or more embodiments.

FIG. 6 depicts a schematic of an illustrative method for diverting at least a portion of a fluid flowing through a pipe to provide an operational power source for use by one or more support equipment units according to one or more embodiments. In one or more embodiments, the interface 92 can include one or more block valves 101, one or more control valves 103, and one or more check valves 105. The control valves 103 can control the pressure of the fluid 60 flowing through pipe 20 and the pressure of the fluid 90 flowing through interface 92. The check valve 105 can prevent back flow from interface 92 into pipe 20. Blocking valves 101 can be disposed in fluid communications with pipe 20 and interface 92 such that when the blocking valves 101 are closed, no fluid can flow between the blocking valves 101, isolating the check valves 105 and the control valves 103.

The blocking valve 101 can be any valve capable of restricting and/or cutting off a fluid flow from one side of the valve to another. For example, the blocking valve 101 can be a globe valve, a gate valve, a butterfly valve, a needle valve, a ball valve, any know two way valve, or any known valve capable of completely blocking a fluid flow. The control valve 103 can be any valve capable of varying the pressure of a fluid flowing through the valve 103. The check valve 105 can be any known one-way valve or any valve capable of preventing two directional fluid flow. All of the valves 101, 103, and 105 can be remotely operated or adjusted. In one or more embodiments, the valves 101, 103, and 105 can be disposed inside the support equipment units 70. In one or more embodiments, the valves are configured to balance the fluid pressure across an entire well producing system, such as well producing system 13 shown in FIG. 1 above. It should be understood that the control valves 103, the check valves 105, and the blocking valves 101 can be arranged in any configuration suitable for diverting at least a portion of the fluid 60 from the pipe 20 to the one or more support equipment units 70. It should be understood that any number of valves and/or valve configurations can be used to divert at least a portion of the fluid 60 from pipe 20 to the one or more support equipment units 70. It should also be understood that any number of pipes can be used in any suitable configuration to divert the fluid 60 from one or more pipes, such as pipe 20, to the one or more support equipment units 70. Once the fluid 90 has transferred at least some of its energy to one or more of the support equipment units 70, the less energetic fluid 74 can be expelled from the support equipment units 70.

Figure 7:
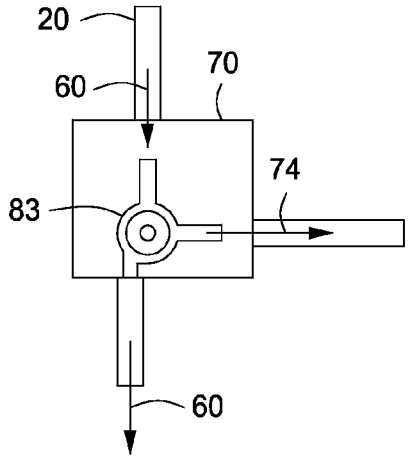
FIG. 7 depicts a schematic of an illustrative method for providing an operational power source to one or more support equipment units according to one or more embodiments.

FIG. 7 depicts a schematic of an illustrative method for providing an operational power source to one or more support equipment units according to one or more embodiments. In one or more embodiments, pipe 20 provides the fluid 60 directly to one or more motors 83 disposed in the one or more support equipment units 70. The one or more motors 83 can convert at least a portion of the energy resident in the fluid 60 into mechanical and/or electrical energy and can expel the fluid 60 down-hole to support a well, such as well 12 depicted in FIG. 1 above. Returning to FIG. 7, the motor 83 can control the fluid pressure in the fluid 60 by siphoning off a portion of the fluid 60 as the expelled fluid 74 and expelling the fluid 74 from the motor 83. The motor 83 can be combined with one or more valves, such as the valves described in FIG. 6 above, to control the fluid pressure in the fluid 60 and the fluid 74.

In one or more embodiments, not shown, a closed loop fluid pressurization system can provide an operational power source directly to the one or more sub-sea support equipment units, for example the sub-sea support equipment units described in FIG. 1 above. The closed loop fluid pressurization system can include pumps and other known equipment for pressurizing a fluid, as well as piping that is in fluid communication with the closed loop system and the one or more sub-sea support equipment units. The piping can carry the pressurized fluid from the closed loop fluid pressurization system to the one or more sub-sea support equipment units for use by the sub-sea support equipment as an operational power source. The closed loop fluid pressurization system can provide the operational power source independently from any water injection and/or gas lift system.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges can appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for providing power to sub-sea support equipment units, comprising:

diverting at least a portion of a pressurized fluid used by a well producing system, wherein the diverted fluid defines a diverted fluid energy source; and providing the diverted fluid energy source to a sub-sea support equipment unit for use as an operational power source, wherein the sub-sea support equipment unit is disposed in the vicinity of a mud-line, wherein the support equipment unit performs at least one processing step on a hydrocarbon, and wherein the at least one processing step on the hydrocarbon comprises dehydration, sulfur removal, or a combination thereof.

2. The method of claim 1, wherein the operational power source comprises one or more direct mechanical links.

3. The method of claim 2, wherein the one or more direct mechanical links connect to a plurality of sub-sea support equipment units.

4. The method of claim 1, wherein the operational power source is electricity generated by converting the diverted fluid energy source into electrical energy.

5. The method of claim 4, further comprising providing at least a portion of the electricity to a plurality of sub-sea support equipment units for use as an operational power source.

6. The method of claim 1, wherein the support equipment unit supports the lifting of a hydrocarbon to above a water line.

7. The method of claim 6, wherein the support equipment unit performs the processing step prior to supporting the lifting of the hydrocarbon to above a water-line.

8. The method of claim 1, further comprising converting the pressurized fluid energy source into electricity.

9. The method of claim 8, further comprising providing the electricity to a plurality of sub-sea support equipment units, wherein the plurality of sub-sea support equipment units are disposed in the vicinity of the mud-line.

10. The method of claim 1, further comprising providing the diverted fluid energy to a plurality of sub-sea support equipment units, wherein the plurality of sub-sea support equipment units are disposed in the vicinity of the mud-line.

11. The method of claim 1, wherein the pressurized fluid used by the well producing system is introduced into a well.

12. The method of claim 1, wherein the pressurized fluid used by the well producing system is introduced into a well to support lifting a production product to above a mud-line.

13. The method of claim 1, further comprising introducing a second portion of the pressurized fluid to the well producing system while the at least a portion of the pressurized fluid is diverted.

14. The method of claim 1, further comprising recovering the diverted fluid energy source from the sub-sea support equipment and introducing at least a portion of the recovered diverted fluid energy source to a well.

15. A method for providing power to sub-sea support equipment units, comprising:

diverting at least a portion of a pressurized fluid used by a well producing system, wherein the diverted fluid defines a diverted fluid energy source; and providing the diverted fluid energy to a plurality of sub-sea support equipment units for use as an operational power source, wherein the plurality of sub-sea support equipment units are disposed in the vicinity of a mud-line, wherein the operational power source is direct mechanical power, and wherein at least one support equipment unit supports the lifting of a hydrocarbon to above a water line, wherein the support equipment unit performs at least one processing step on a hydrocarbon, and wherein the at least one processing step on the hydrocarbon comprises dehydration, sulfur removal, or a combination thereof.

16. A system for providing power to sub-sea support equipment units, comprising:

means for converting at least a portion of a fluid source used by a well finishing system into an energy source suitable for providing power to a sub-sea support equipment unit disposed in the vicinity of a mud-line, and means for providing the energy source to the sub-sea support equipment unit, wherein the support equipment unit performs at least one processing step on a hydrocarbon, and wherein the at least one processing step on the hydrocarbon comprises dehydration, sulfur removal, or a combination thereof.

17. The system of claim 16, wherein the energy source suitable for providing power to a sub-sea support equipment unit comprises one or more direct mechanical links.

18. The system of claim 16, wherein the energy source suitable for providing power to a sub-sea support equipment unit is electrical energy.

19. The system of claim 16, wherein the support equipment unit supports the lifting of a hydrocarbon to above a water line.

20. The system of claim 16, wherein the support equipment unit performs at least one processing step on a hydrocarbon.

21. The system of claim 16, wherein the support equipment unit performs the processing step prior to supporting the lifting of the hydrocarbon to above a water-line.

22. The system, of claim 16, further comprising means for providing the energy source to a plurality of support equipment units.

* * * * *